US007621986B2

(12) United States Patent
Bologa et al.

(10) Patent No.: US 7,621,986 B2
(45) Date of Patent: Nov. 24, 2009

(54) ELECTROSTATIC IONIZATION SYSTEM

(75) Inventors: Andrei Bologa, Stutensee (DE); Hanns-Rudolf Paur, Karlsruhe (DE); Klaus Woletz, Eggenstein-Leopoldshafen (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 68 days.

(21) Appl. No.: 12/067,627

(22) PCT Filed: Sep. 7, 2006

(86) PCT No.: PCT/EP2006/008731

§ 371 (c)(1),
(2), (4) Date: Mar. 20, 2008

(87) PCT Pub. No.: WO2007/033772

PCT Pub. Date: Mar. 29, 2007

(65) Prior Publication Data

US 2008/0250930 A1 Oct. 16, 2008

(30) Foreign Application Priority Data

Sep. 21, 2005 (DE) ..... 10 2005 045 010

(51) Int. Cl.
*B03C 3/06* (2006.01)

(52) U.S. Cl. ..... 96/73; 55/DIG. 38; 96/95; 96/97; 96/98

(58) Field of Classification Search ..... 96/65, 96/66, 70, 73, 83, 88, 95–100; 55/DIG. 38
See application file for complete search history.

(56) References Cited

U.S. PATENT DOCUMENTS

| | | | | | |
|---|---|---|---|---|---|
| 1,130,212 | A | * | 3/1915 | Steere | 95/81 |
| 1,473,806 | A | * | 11/1923 | Bradley | 96/28 |
| 1,605,648 | A | * | 11/1926 | Cooke | 95/79 |
| 1,992,113 | A | * | 2/1935 | Anderson | 96/88 |
| 2,409,579 | A | * | 10/1946 | Meston | 96/97 |
| 2,505,907 | A | * | 5/1950 | Meston | 96/97 |
| 2,525,347 | A | * | 10/1950 | Gilman | 95/71 |
| 3,765,154 | A | * | 10/1973 | Hardt et al. | 96/88 |
| 4,194,888 | A | * | 3/1980 | Schwab et al. | 95/78 |
| 4,222,748 | A | | 9/1980 | Argo et al. | |
| 4,247,307 | A | * | 1/1981 | Chang | 95/79 |

(Continued)

FOREIGN PATENT DOCUMENTS

DE 10132582 8/2002

(Continued)

*Primary Examiner*—Richard L Chiesa
(74) *Attorney, Agent, or Firm*—Darby & Darby

(57) ABSTRACT

An electrostatic ionization system in a precipitation device for purifying a gas stream passing through it includes: an electrically conductive plate including a plurality of nozzles configured for passage of the gas stream; a sleeve positive-fittingly disposed on each nozzle; a high-voltage grid; a plurality of rod-shaped high-voltage electrodes each having an end connected to the grid and an exposed free end arranged identically centrally in a corresponding one of the nozzles, the electrodes each forming a circumferential gap and arranged at an electrical potential of the grid, wherein the free end of each of the electrodes is exposed downstream after the corresponding nozzle, wherein a wall of each sleeve is permeable to the gas stream and includes at least one of a grid, a perforated sheet and individual rods equidistantly spaced from each other and having free ends terminating in a holding ring.

15 Claims, 8 Drawing Sheets

U.S. PATENT DOCUMENTS

| | | | | | |
|---|---|---|---|---|---|
| 4,354,858 | A | | 10/1982 | Kumar et al. | |
| 4,449,159 | A | * | 5/1984 | Schwab et al. | 96/62 |
| 4,675,029 | A | * | 6/1987 | Norman et al. | 95/73 |
| 5,254,155 | A | * | 10/1993 | Mensi | 96/44 |
| 5,474,600 | A | * | 12/1995 | Volodina et al. | 96/57 |
| 6,228,148 | B1 | * | 5/2001 | Aaltonen et al. | 95/74 |
| 6,294,003 | B1 | * | 9/2001 | Ray | 96/49 |
| 6,508,861 | B1 | * | 1/2003 | Ray | 95/79 |
| 6,527,829 | B1 | * | 3/2003 | Malkamaki et al. | 95/71 |
| 6,632,267 | B1 | * | 10/2003 | Ilmasti | 95/59 |
| 6,858,064 | B2 | | 2/2005 | Bologa et al. | |
| 7,101,424 | B2 | | 9/2006 | Wascher et al. | |
| 7,517,394 | B2 | * | 4/2009 | Bologa et al. | 96/52 |
| 7,563,312 | B2 | * | 7/2009 | Wascher et al. | 96/274 |
| 2004/0139853 | A1 | * | 7/2004 | Bologa et al. | 95/64 |
| 2007/0283903 | A1 | * | 12/2007 | Bologa et al. | 122/4 R |
| 2008/0302241 | A1 | * | 12/2008 | Bologa et al. | 95/71 |

FOREIGN PATENT DOCUMENTS

| | | | | | |
|---|---|---|---|---|---|
| DE | 10244051 | | | 11/2003 | |
| DE | 10319351 | | | 11/2004 | |
| DE | 102005023521 | | | 6/2006 | |
| GB | 686779 | | | 1/1953 | |
| JP | 56-78645 | A | * | 6/1981 | 96/97 |
| JP | 5-154408 | A | * | 6/1993 | 96/97 |
| JP | 2001198488 | | | 7/2001 | |
| WO | 2004041439 | | | 5/2004 | |

* cited by examiner

Fig. 4a
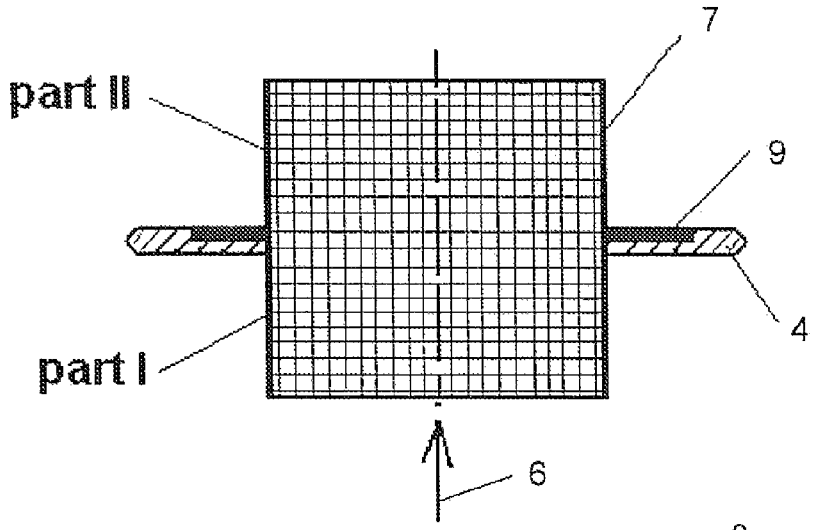
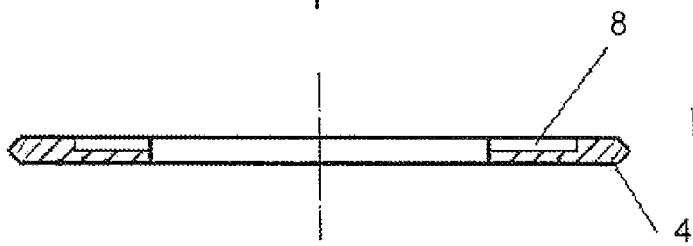
Fig. 4c
Fig. 4b
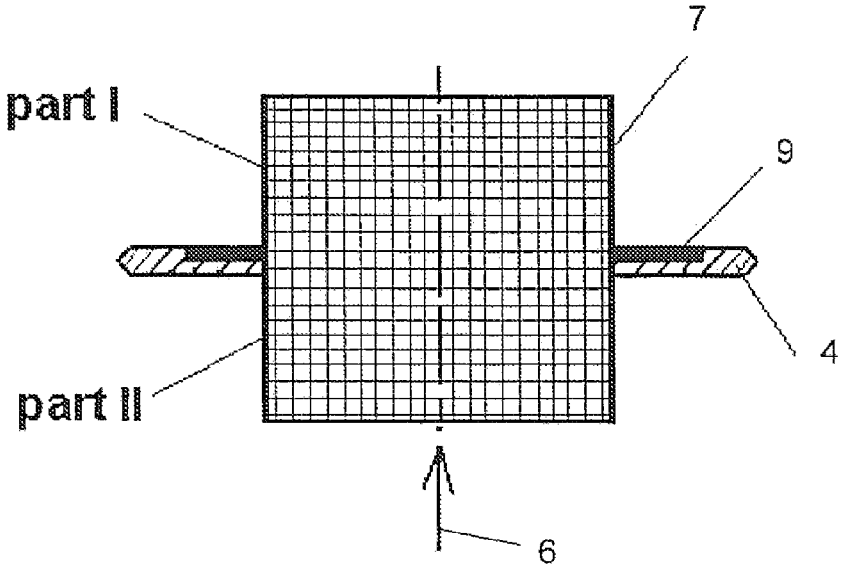

Fig. 6
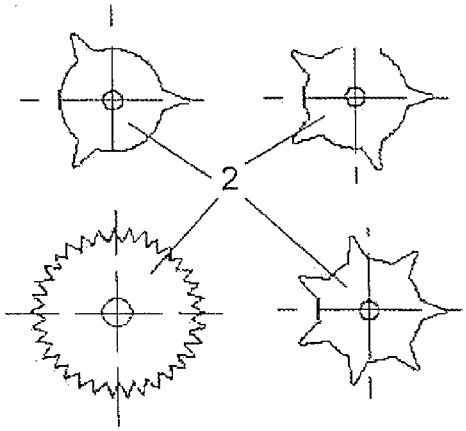
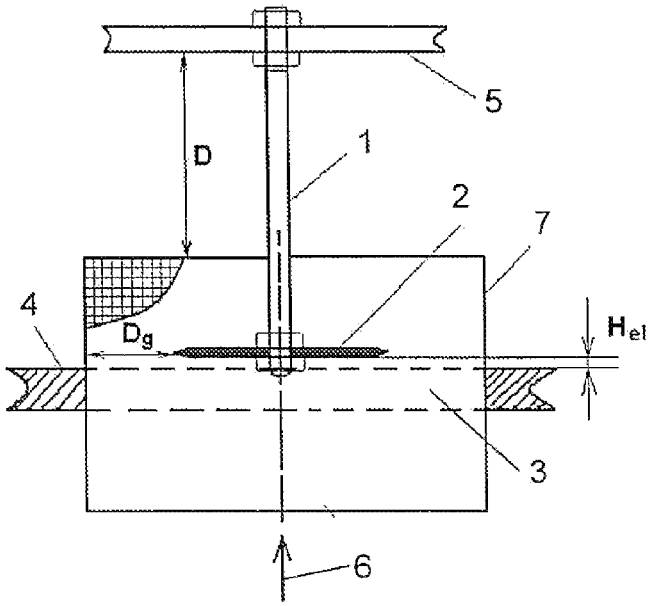
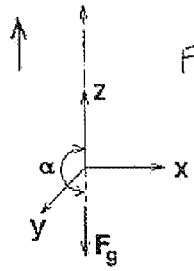
Fig. 7c
Fig. 7a
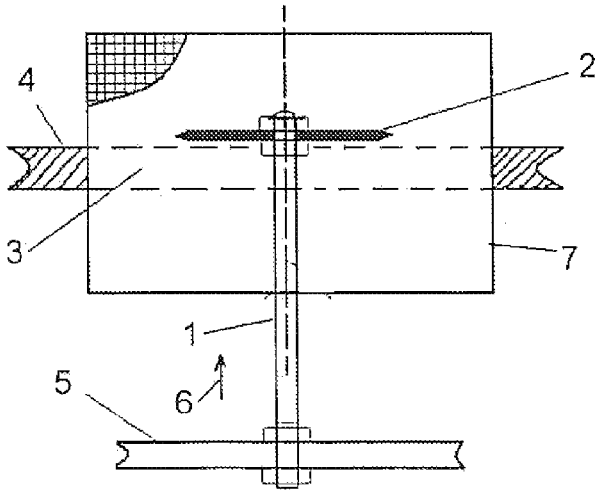
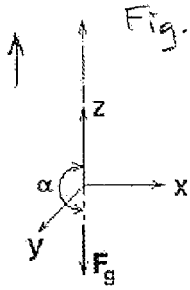
Fig. 7d
Fig. 7b

ELECTROSTATIC IONIZATION SYSTEM

CROSS-REFERENCE TO RELATED APPLICATIONS

This is a U.S. national phase application under 35 U.S.C. § 371 of International Patent Application No. PCT/EP2006/008731, filed Sep. 7, 2006, and claims benefit of German Patent Application No. 10 2005 045 010.5, filed Sep. 21, 2005. The International Application was published in German on Mar. 29, 2007 as WO 2007/033772 A1 under PCT Article 21(2).

FIELD

The invention relates to an electrostatic ionization stage in an electrostatic, in particular wet electrostatic, precipitation device for purification of a gas stream, made up of an aerosol, passed through it.

BACKGROUND

A wet electrostatic precipitator is a unit that is built into a conduit segment of a gas passage and separates finely divided solid or liquid particles from a gas stream or aerosol stream. Devices of this kind are therefore an indispensable component in production sectors of many kinds.

The process for separating the finely divided particles from the gas stream includes the following steps:

electrostatically charging the particles;

collecting the charged particles on the surface of an electrode or electrodes;

removing the charged particles from the surface of the collecting electrodes.

Electrostatic purification of an aerosol, i.e. finely divided particles in a gas stream, is usually achieved by way of negatively or positively charged particles (ions). They are generated by corona discharge, and become an actual electrical current because of the air gap between an electrode that is at an electrically positive or negative reference potential (usually ground potential) and a negative ionization electrode that is at an opposite electrical potential. These electrodes are connected to a high voltage source of the requisite polarity that supplies a direct current. The value of the applied voltage depends on the spacing between the electrodes and on the properties of the gas stream to be processed.

The efficiency of an electrostatic precipitator depends, over a wide range, on the intensity of the charge delivered to the particles by the charging segment. The charge intensity can be raised by increasing the electrostatic field in the ionization segment of the precipitator. The usual maximum intensity of the electrostatic field is limited to, at most, the value at which flashovers begin.

In wet electrostatic precipitators, the ionization and collection zones are combined in one unit. The collector tubes are often long, and therefore cause problems with adjustment of the discharge electrodes. Corona discharge stability in the ionization regions is also often influenced by the washing or rinsing (with water) of the internal surface of the collector tubes. These problems are described in DE 101 32 582 C1 and DE 102 44 051 C1, where the wet electrostatic precipitator is made up of a separate ionization region and collection region. The particles are charged by corona discharge in an intense electrostatic field. The corona discharge occurs in the gap between needle or star electrodes and the openings or nozzles of the grounded plate, when the needle or star electrodes are or become connected to DC high voltage. Oriented to the direction of the gas flow, the discharge electrodes project from downstream into the openings or nozzles of the grounded plate. The charged particles are collected in the grounded tube-bundle collector that follows the high-voltage electrodes downstream and is installed downstream from the ionization device.

A configuration of the wet electrostatic ionization stage is described in DE 101 44 051. The stage includes a plate, connected to ground potential or to a positive reference potential or counter-potential, that is installed across the open cross section of a flow conduit segment and has a plurality of identical openings through which the gas to be purified can flow. It is followed downstream by a high-voltage grid that is installed in electrically insulated fashion across the open cross section of the conduit segment, and is connected to a high-voltage potential via a passthrough in the wall of the conduit segment. A plurality, corresponding to the openings, of rod-shaped high-voltage electrodes are mounted at one end on this high-voltage grid and aligned. These high-voltage electrodes each point or project with their free end, identically and centrally, into an opening or nozzle of the plate.

A disk made of electrically conductive material, or at least coated therewith, sits in electrically connected fashion at each free end of a high-voltage electrode of this kind, centrally and parallel to the plate without touching it. Said disk has, evenly distributed around the circumference, at least two radial protrusions or tips that are directed radially or slightly outward, tilted toward the gas stream.

Operation of the wet electrostatic precipitator shows that increasing the applied voltage, which means increasing the electrical field strength in the electrode gap, provokes a spark discharge that occurs in a manner corresponding to the non-homogeneous electric field between the electrodes and the edges of the openings or nozzles. This decreases particle charging efficiency and particle collection efficiency in the electrostatic precipitator.

DE 10 2005 023 521 describes a wet electrostatic ionization stage in an electrostatic precipitation device for removing, from an aerosol, i.e. a gas, finely divided particles that are also transported in the gas. It comprises a plate, connected to ground potential or to a referred counter-potential, that is installed across the open cross section of a flow conduit segment and has a plurality of identical openings through which the gas to be purified can flow. The ionization stage has a high-voltage grid that is installed in electrically insulated fashion across the open cross section of the conduit segment, downstream or upstream in the gas flow with respect to the plate, and is connected to a high-voltage potential via a passthrough in the wall of the conduit segment. It additionally has a plurality, corresponding to the openings or nozzles) of rod-shaped high-voltage electrodes that are mounted at their one end on the high-voltage grid and each project with their free end, in identically central fashion in each case, into a nozzle of the nozzle plate. At these free ends, identically in each case, a disk made of electrically conductive material sits centrally and parallel to the plate without touching it. A disk has, evenly distributed around its circumference, at least two radial outward protrusions or tips.

Depending on overall size and electrical potential conditions, the distance D between the high-voltage grid and the end face of the sleeves that faces it is at least such that the possibility of spark discharge between these two physical assemblies during operation of the precipitator is ruled out. This is a high-voltage engineering design that accounts for the process environment.

Inserted identically into each nozzle having a simple convex round or polygonal open cross section is a sleeve of similar cross section whose axis is perpendicular to the plate that is at reference potential (often ground potential). In consideration of operating conditions, in particular the intensity of the gas flow, the sleeve often also sits in frictionally engaged fashion to neutralize normal operating influences, and because of the provision of maintenance work is mounted or positioned releasably in the nozzle.

The disk is exposed, inside the sleeve, at the free end of this rod-shaped high-voltage electrode. A simple convex round or polygonal enveloping curve of the disk has, circumferentially, a constant spacing L with respect to the sleeve. In the gap between the inner wall of the sleeve and the rim of the disk, the electrical potential difference is made up of the high-voltage potential and reference or ground potential.

For efficient long-term operation of the electrostatic precipitator, it is important that the electrical conditions be maintained or can be maintained. This means that, in particular, the geometry established between the nozzle plate and the high-voltage electrodes positioned at it remain unchanged in order to limit electrical flashovers and suppress high-current discharges.

With the construction of the ionization stage as described in DE 10 2005 023 521, upon extended operation a deposition of particles on the impermeable sleeve wall was unavoidable; this then modified the electrical situation in the gaps between the nozzles or sleeves and the respectively associated high-voltage electrodes disadvantageously (in the direction of more flashovers), and resulted ultimately in loss of effectiveness due to short circuit.

SUMMARY

It is an aspect of the invention to provide an ionization stage for an electrostatic precipitator that exhibits stable long-term behavior, so that a relatively low number of flashovers or discharges occur in gaps between the nozzles of the nozzle plate and the positioned ends of the high-voltage electrodes.

In an embodiment the present invention provides an electrostatic ionization system in a precipitation device for purifying a gas stream passing through it. The electrostatic ionization system includes: an electrically conductive plate connected to an electrical reference potential, the plate disposed across an open cross section of a flow conduit of the precipitation device and including a plurality of nozzles configured for passage of the gas stream; a sleeve positive-fittingly disposed on each nozzle coaxial with an axis of the nozzle, the sleeve protruding on both sides of the plate and being an electrical reference potential of the plate; an electrically insulated high-voltage grid disposed downstream or upstream of the plate across the open cross section of the conduit, the high-voltage grid being connected to a high-voltage potential via a passthrough in a wall of the conduit; a plurality of rod-shaped high-voltage electrodes each having an end connected to the high-voltage grid and an exposed free end arranged identically centrally in a corresponding one of the nozzles, the electrodes each forming a circumferential gap and arranged at the electrical potential of the high-voltage grid, wherein the free end of each of the electrodes is exposed downstream after the corresponding nozzle, wherein a wall of each sleeve is permeable to the gas stream and includes at least one of a grid, a perforated sheet and individual rods equidistantly spaced from each other and having free ends terminating in a holding ring.

BRIEF DESCRIPTION OF THE DRAWINGS

Aspects of the present invention will now be described by way of exemplary embodiments with reference to the following drawings, in which:

FIGS. 1*a-c* show an ionization stage with needle-shaped high-voltage electrodes, according to an exemplary embodiment of the present invention;

FIGS. 4*a-c* show a sleeve with an outer ring, according to an exemplary embodiment of the present invention;

FIG. 6 shows a free end of the high-voltage electrode in disk form, according to an exemplary embodiment of the present invention;

FIGS. 7*a-d* show a nozzle plate and high-voltage electrode as installed, according to an exemplary embodiment of the present invention;

FIGS. 10*a-d* shows a nozzle plate and high-voltage electrode as installed, according to an exemplary embodiment of the present invention.

DETAILED DESCRIPTION

Figure 1A:
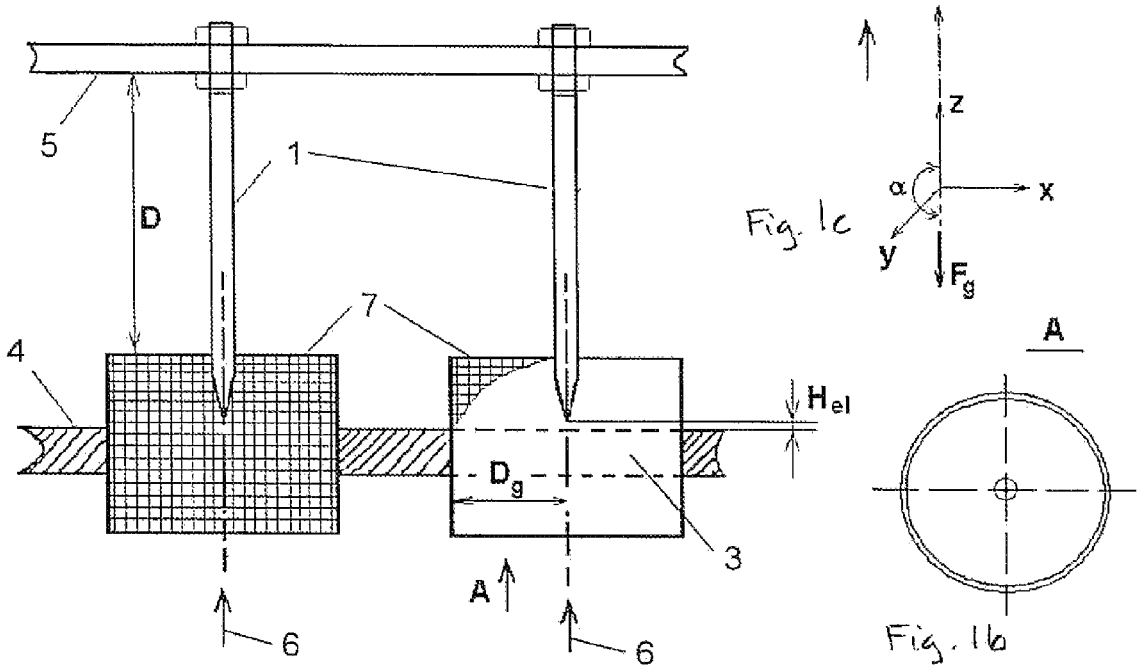

In an embodiment of the present invention the particles precipitated at the nozzles are immediately and effectively removed from the gas stream. The ionization stage is of simple and maintenance-friendly construction. Manufacturing costs are capable of being kept competitively low.

Experiments have shown that the free end, of whatever configuration, of a high-voltage electrode needs to be exposed downstream from the nozzle associated with it. Particle precipitation was most efficient in this context.

The present invention avoids the degradation in the electrical situation in the gap, and is achieved by way of a particle-permeable sleeve wall. The sleeve wall must therefore have passages having an open cross section that is at least larger than the largest particle cross section of the particles entrained in the gas stream; the wall is now sieve-like or gap-like. For this purpose, the sleeve wall comprises a grid having a corresponding minimum mesh size; or a perforated ribbon or sheet having openings of such a minimum open cross section; or rods, proceeding with a constant spacing from one another, each of whose ends terminate in a holding ring. In the latter case, the sleeve wall passage would be ribbon-shaped, directly adjacent rods having at least the spacing of the largest particle diameter. The rods could proceed parallel to the nozzle axis or could wind more or less steeply therearound. In the case of the sleeve wall made of rods, the rods belonging to each sleeve are to be grasped at their two ends by two rings, manufactured with a contour similar to that of the nozzle rim.

A third ring could also, for positive and frictionally engaged positioning, sit at the contact point with the nozzle.

The passages in the sleeve wall also cannot be arbitrarily large. The electrical potential surface in an opening or passage in the sleeve wall must follow that of the sleeve wall, or may at most bulge out slightly therefrom, so that electrical effectiveness on the particles entrained in the gas stream remains limited substantially to the respective gap.

In general, the nozzle material is electrically conductive in order to ensure establishment of the requisite electrical potential. Metallic materials may be used. A highly electrically conductive composite fiber material is also a possibility depending on the case. Electrically non-conductive materials are conceivable as sleeve material if, given highly electrically conductive moisture in the gas stream and the liquid film precipitated therefrom on the gap surface, the predetermined electrical potential distribution is created reliably and uninterruptedly. The material selected as the sleeve wall can be decided on based on the atmosphere to which it is exposed; in addition to mechanical and electrical effects, it must behave inertly therein. Composite fiber material and plastic are thus basic materials for the sleeve material.

The free end of the high-voltage electrodes may be anchored in the high-voltage grid comprise, in the simplest case, the end face of the rod end in the cross-sectional shape of the high-voltage electrode. The free end region of the high-voltage electrode can, however, also taper in sharp or blunt fashion as the rod cross section decreases. Both approaches are simple in terms of design.

A different configuration may be provided where the free end of the high-voltage electrodes, namely that the respective free end of the high-voltage electrodes comprises a disk sitting centrally on the free rod end of the high-voltage electrode, which disk has at least two identical expansions evenly distributed around the outer circumference and proceeding in a radial direction from the longitudinal axis of the high-voltage electrode. Shapes are presented, for example, in the description of the exemplifying embodiment.

In general, the material of the high-voltage electrodes is metallic for reliable formation of the electrical potential, but must in any event be suitable for its surroundings.

The effective free end region (which is important for forming the gap) of the high-voltage electrode is positioned in the range of $0 \leqq H_{el} \leqq 0.5\ D_g$ with respect to the outlet of the nozzle, i.e. in any event downstream in the outlet region of the associated nozzle in the nozzle plate. $D_g$ is the shortest distance from the free electrode end to the inner wall of the sleeve, i.e. the smallest gap width.

The following range proves advantageous for the gap width $D_g$ between inner sleeve wall and free electrode end, namely when an enveloping curve circumscribing the free end of the high-voltage electrode, in a shape similar to that of the open cross section of the nozzle, is at a constant distance $D_g$ from the rim of the nozzle, and the height H of the sleeve is in the range $0.5\ D_g \leqq H \leqq 3\ D_g$ (Claim 5).

It is important that the nozzles sit in the nozzle plate in stationary and positively fitting fashion during operation. A positive fit is necessary to prevent the gas stream from bypassing out around the sleeve. The gas stream (the aerosol) must pass entirely through the ionizing gap, formed in each case by a sleeve and the free end of the high-voltage electrode positioned in it. An exemplifying solution of simple design may be provided where each sleeve has around its circumference a constriction with which it can snap in stationary fashion into its nozzle. Another variant may be provided where a circumferential annular disk sits externally on the sleeve wall concentrically with the sleeve axis, and is placed in positively fitting fashion in a recess concentric with the nozzle axes, for example in such a way that the disk must be pushed with some pressure into said recess so that it sits in clamped fashion therein. Positive fit, frictional engagement, and releasability are thereby achieved. Other technical solutions for sleeve seating are not thereby excluded, provided they are economical and technically not too complex.

For the spatial succession of high-voltage grid and nozzle plate, it has been found experimentally that it is advantageous if, in the case where the free end of the high-voltage electrode is a rod end, the high-voltage grid and the free ends of the high-voltage electrodes sit downstream from the nozzle plate. This is useful for a vertical gas or aerosol flow from top to bottom and vice versa, and also for a horizontal flow; the flow axis is always parallel to the nozzle/sleeve axes, and the installation position is thereby defined.

The free end of the high-voltage electrodes may be configured such that only the free ends of the high-voltage electrodes sit downstream from the nozzle plate in the case where the free end of the high-voltage electrode is a disk. The high-voltage grid can then, in consideration of the gas/aerosol flow direction, sit before or after the nozzle plate. The installation position is vertical for both flow directions, but also possibly horizontal depending on the unit's situation.

It has been found experimentally to be advantageous if the free end of the high-voltage electrode sits in a range from $0 \leqq H_{el} \leqq 0.5\ D_g$ downstream from the nozzle outlet, $0.1\ D_g$–$0.2\ D_g$ having been identified as the best range. $H_{el}$ is the spacing of the effective free end of the high-voltage electrode from the downstream side of the nozzle plate.

An improvement in purification of the gas flowing through may be provided by the sleeves taper, on the aerosol downstream end face, with an open cross section that is constant or becomes larger.

In the simplest case, the sleeve shape is cylindrical, i.e. round in cross section, or prismatic, i.e. polygonal in cross section. The sleeves protrude on either side of the nozzle plate. This can vary when the protrusion is the same on both sides, i.e. the protrusion $H_{up}$ on the inflow side of the nozzle plate is approximately equal to the protrusion $H_{ds}$ on the downstream side. In this case simple sleeve geometries can also be reinserted by 180° with no change in nozzle plate geometry.

If, for example, the flow velocity in the nozzle is above 6 m/s, and the flow direction is from bottom to top, i.e. against gravity, it is advantageous to keep the protrusion ratio in the range $H_{up}=(1 \text{ to } 5)H_{ds}$.

If the flow direction is vertically downward, i.e. in the direction of gravity, the optimum range of the protrusion ratio is $H_{up}=(0.1 \text{ to } 1)H_{ds}$.

For better collection and dripping of the liquid that has collected on the sleeve wall out of the gas stream flowing through, it is entirely advantageous if the wall of the sleeves is locally elongated at the physically lower end face. This can be achieved, for example, by a section surface oblique to the sleeve axis; the section surface can be straight or have a simple curve. The lower end face of a sleeve can, however, also be obtained by way of two cuts oblique to the sleeve axis, and then has two end-face points that are located lower than the rest of the end face. The axis of the nozzle also has, at this lower end surface, a local elongation of the sleeve made of sleeve material, so that the surface then enclosed by the free lower end surface is no longer perpendicularly penetrated by the axis of the nozzle.

Often, however, isolated larger particles are entrained in an aerosol stream and, over the longer term, can clog the gap in the sleeve interior. This can be prevented by installing across the flow cross section in the flow conduit, at an accessible point, a sieve whose mesh size is such that only particles of tolerable size can flow through. A sieve of this kind must be regularly cleaned or purged. A large-particle barrier of this kind can, however, also be shifted into the ionizer by the fact that, each sleeve inlet is equipped with a sieve whose mesh size is coordinated with the gap width in such a way that particles likely to clog cannot flow into the sleeve. The sleeves, having a simple round cylindrical construction or a columnar one that is polygonal in section, are equipped for this purpose, at their respective flow inlet, with a sieve that has a mesh size at least equal to the passthrough width of the permeable sleeve wall, and that during operation assumes the electrical potential of the nozzle plate.

The use of the sleeve having a particle-permeable wall improves the distribution of the electric field in the gap between the inner wall of the sleeve and the free end, positioned inside the sleeve, of the associated high-voltage electrode, and thus in the zone for electrical charging of the particles. The electric field is formed substantially between the free end of the electrode and the inner wall of the sleeve. As a result, the nozzles in the nozzle plate can be produced very easily. Edges on the nozzle resulting from drilling, milling, or stamping can remain, or at least no longer need to be carefully rounded, in order not to provoke a spark flashover.

Under the influence of the gas flow and the electric wind (which latter is generated in the corona discharge in the gap), aerosol that collects on the inner wall of the sleeve pushes through the meshes or openings or passages onto the outer wall of the sleeve and flows off there having been electrically neutralized. This prevents, or at least very considerably suppresses, the number of spark discharges that have been observed on sleeves having a solid wall.

The sleeve having a permeable wall also improves the collection effectiveness of the wet electrostatic collector, since part of the liquid aerosol is collected or deposited on the inner wall of the sleeve. The collected aerosol flows off in the form of large drops on the outer wall of the sleeve and is electrically discharged or neutralized in that context. The drops are largely on the outer wall of the sleeve, and do not provoke any spark discharge. The collected liquid aerosol, in the form of drops, flows down the sleeve and drips off from the lower end face of the sleeve. This ensures a self-cleaning effect for the sleeve, and thus makes superfluous any additional external cleaning of the ionization stage.

Use of the permeable sleeve decreases the degree to which the downstream part of the nozzle plate is contaminated with collected aerosol.

Use of the permeable sleeve enhances the operating stability of the ionization stage.

The manner of operation of the electrostatic precipitator having permeable-wall sleeves 7 is as follows:

When a gas loaded with particles (an aerosol) enters the electrostatic precipitator, it flows in the ionization stage through nozzles 3 in nozzle plate 4. Nozzle plate 4 is installed in the flow conduit across the entire open conduit cross section, so that the gas to be purified flows on only through nozzles 3 fitted with the permeable-wall sleeves 7. Nozzle plate 4, together with sleeves 7 inserted on it, is connected to an electrical reference potential, usually ground potential, and thus constitutes an equipotential surface. As the aerosol flows, a portion will flow through sleeves 7 and the other portion through the sleeve walls, depending on the sleeve protrusion.

When high-voltage grid 5 is connected to high voltage, an electrostatic field exists in gap $D_g$ between sleeve 7 and the free end of high-voltage electrode 1 that projects centrally into it. As the voltage rises, the field strength rises; the latter is also very inhomogeneous at the sharp regions of the free end of high-voltage electrodes 1. The corona discharges begin there. The corona discharge generates electrons and ions, and thereby charges the entrained particles. These particles are collected or deposited in the collector portion of the electrostatic precipitator.

The motion of the ions brought about by the corona discharge generates additional motion of the air through the electric field. This effect is referred to as an "electric wind." The electric wind blows out from the location of the corona discharge toward the permeable wall of the sleeve. The velocity of the electric wind can reach 5 to 8 m/s. This is comparable to the flow velocity of the gas stream through the ionization stage, thus producing a resultant velocity made up of the flow velocity and electric wind velocity.

When the electrostatic precipitator is in operation, some of the charged droplets collect on the inner wall of the sleeve and form a liquid film or large drops. The electric wind blows the liquid film or droplets through the permeable wall of the sleeve, and the precipitated particles or liquid, having been electrically neutralized, thus collect on the outer wall of the sleeve. As compared with the use of a precipitator having a thick nozzle plate or a tube precipitator in the wet electrostatic precipitator, the use of the nozzle plate having permeable-wall sleeves results in a decrease in spark discharges in the ionization stage. The liquid collected on the inner and outer wall of the sleeves is electrically neutralized because of the reference or ground potential, and as a result runs or drips off more easily. Contamination is thus decreased or at least considerably extended over time, thereby substantially enhancing the operating stability of the precipitator.

FIGS. 1*a-c* show a portion of the ionization stage. It includes grounded plate 4 (the nozzle plate) having identical nozzles 3 of circular-disk shape and high-voltage grid 5 that is downstream but physically above (see FIG. 1*c*, indicating the gas flow and the direction of gravity $F_g$). The direction of gas flow 6 here is vertically upward. High-voltage electrodes 1, which here are rod- or needle-shaped, are bolted at one of their ends on high-voltage grid 5 and are positioned with their free, needle-shaped end, centrally and coaxially with respect to the electrode/nozzle axis, centrally inside sleeve 7 that has a circular cross section and is made of mesh grid. Nozzle plate 4, high-voltage grid 5, and high-voltage electrodes 1 are here made, for example, of special steel, as is the sleeve, but they can also be made of dielectric or semiconducting material if they are covered during operation with an electrically conductive liquid film. The liquid comes out of the gas flowing through in the wet electrostatic precipitator. Sleeve 7 made of mesh grid sits in positively fitting fashion so that gas stream 6 can flow from below only through sleeves 7 and cannot flow past or around them. The tip of high-voltage electrode 1 is here positioned in the range $0 \leqq H_{el} \leqq 0.5\ D_g$, preferably at $H_{el}=0.1$ to $0.2\ D_g$.

Figure 2:
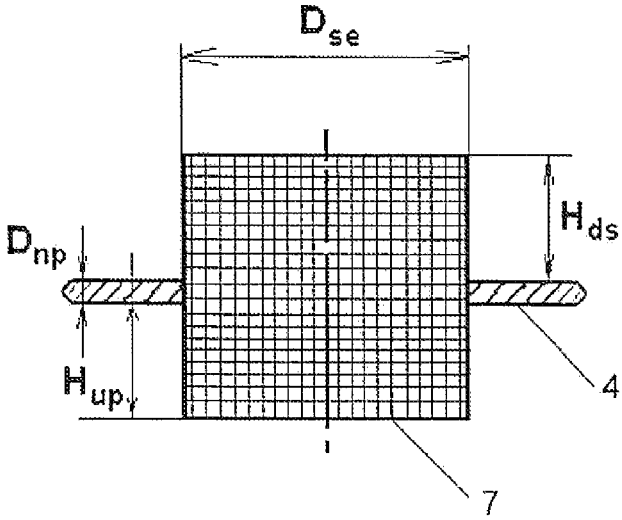
FIG. 2 shows a sleeve made of a mesh grid, according to an exemplary embodiment of the present invention.

FIG. 2 shows a section through the permeable sleeve made of mesh grid and the region of the nozzle plate where it sits. The total height of the sleeve is $H=H_{up}+D_{np}+H_{ds}$; it is made up of the two protrusions $H_{up}$ and $H_{ds}$ and thickness $D_{np}$ of the nozzle plate. $D_{se}$ is the diameter of the sleeve. Here the ratio of the two protrusions $H_{up}:H_{ds}$ is approximately 1.

Figure 3:
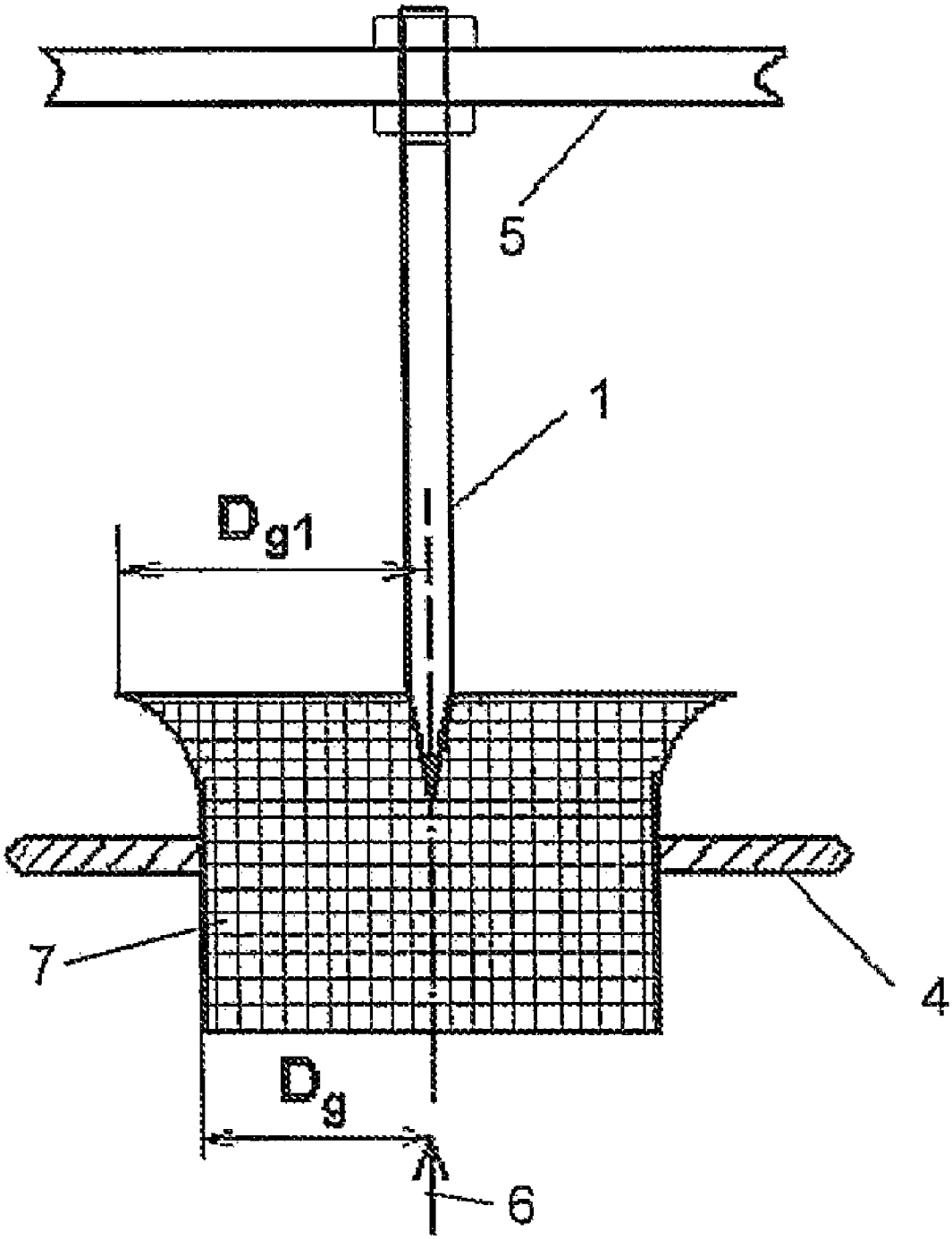
FIG. 3 shows a sleeve with a trumpet-shaped outlet, according to an exemplary embodiment of the present invention.
Figure 5A:
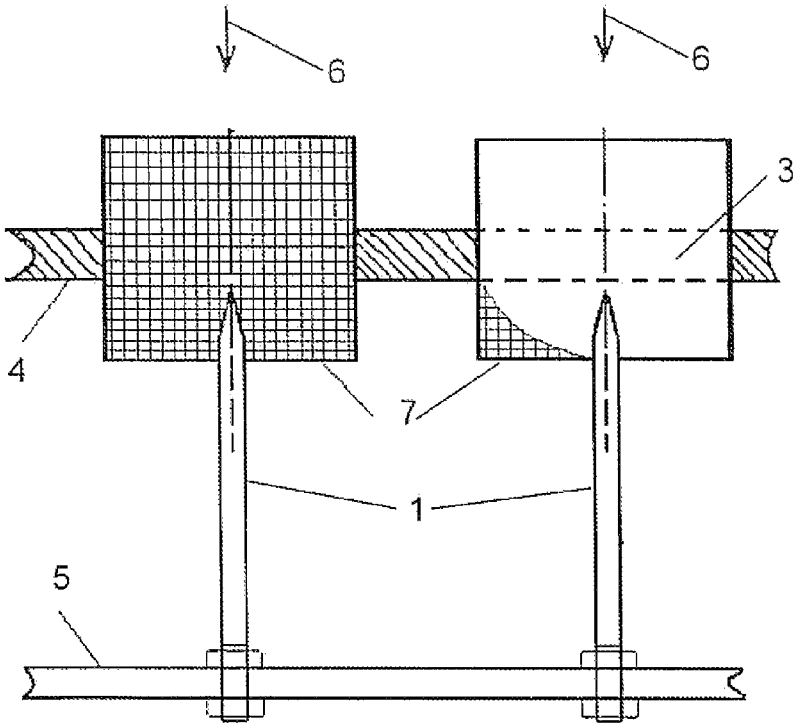
FIGS. 5*a-d* show an ionization stage in various positions, according to an exemplary embodiment of the present invention.
Figure 5C:
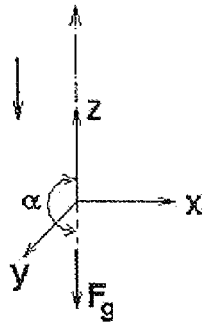
Figure 5B:
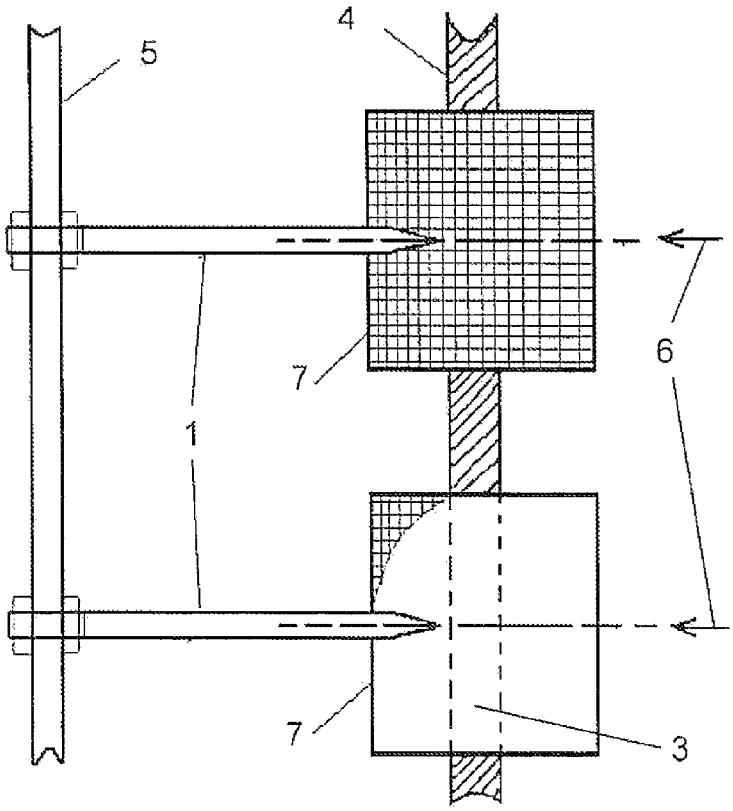
Figure 5D:
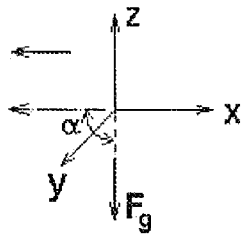
Figure 8A:
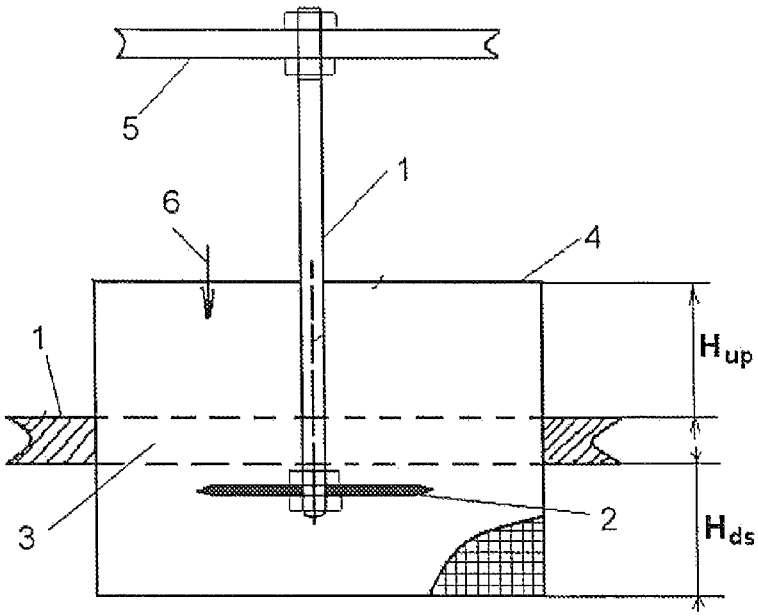
FIGS. 8*a-d* show a nozzle plate and high-voltage electrode as installed, according to an exemplary embodiment of the present invention.
Figure 8C:
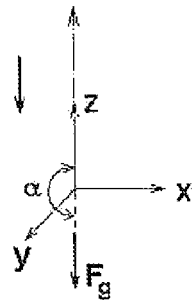
Figure 8B:
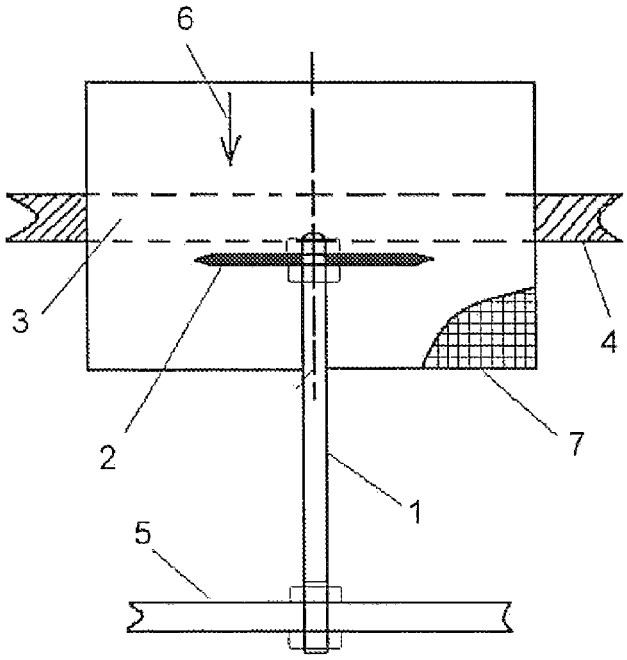
Figure 8D:
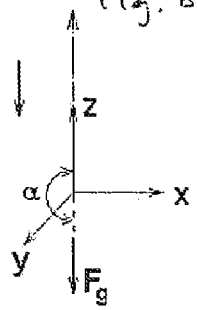

FIG. 3 depicts a permeable sleeve made of mesh grid that widens at its flow outlet. The spacing $D_{g1}$ of the widened sleeve rim is much larger than gap width $D_g$, i.e. $D_g<D_{g1}$. This allows spark discharges between high-voltage electrode 1 and the outlet of sleeves 7 to be suppressed.

FIGS. 4*a-c* depicts the permeable sleeve 7 made of mesh grid with a coaxially surrounding annular disk 9. Annular disk 9 rests in nozzle plate 4 in positively fitting fashion in a recess 8 concentric with nozzle 3, and sits therein in frictionally engaged fashion at least to the extent that it remains nondisplaceable in normal operation. This can be achieved, for example, by pressing or snap-locking. In general, the protrusions $H_{up}$, $H_{ds}$ of sleeve 7 can be different on the two sides. If they are identical or approximately identical, a useful advantage exists in that sleeve 7, if its grid is contaminated with non-water-soluble substances from the aerosol, can simply be removed and reinserted having been rotated 180°, thus eliminating one replacement phase, i.e. the service life is doubled, but at least extended.

FIGS. 5*a-d* show the ionization stage in different angular positions with regard to flow direction 6 and effective gravity $F_g$. In the upper ionization stage portion, gas stream 6 flows vertically from top to bottom. Nozzle plate 4, with its nozzles 3, sits physically above high-voltage grid 5, and high-voltage electrodes 1, in rod form only, project as needles from below into their respectively associated sleeve 7. High-speed grid 5, together with high-voltage electrodes 1, sits downstream. The action of gravity $F_g$ in the direction of the negative Z axis is indicated in the x, y, z tripod in FIG. 5*c*. A flow situation rotated 180° is sketched, for example, at the top of FIG. 1*a*. In the ionization stage portion in FIG. 5*b*, flow occurs onto nozzle plate 4 horizontally from the right. High-voltage grid 5 having the bolted-on high-voltage electrodes 1 sits downstream, and the tips are positioned downstream in sleeve 7 in front of the nozzle outlet. In general, the ionization stage can be installed, in terms of the direction of gravity, at an angle $0 \leqq \alpha \leqq 180°$, and thus does not represent a physical obstacle in the conduit for the gas stream.

Disk 2, for example in the shape of a regular star, inserted as the free end on the respective high-voltage electrode 1, is depicted in FIG. 6 in two installation positions. Disk 2, having the regular three-, five-, seven- and multi-toothed shapes, is depicted between the two installation positions. The tooth contour, located centrally/coaxially with respect to the rod of high-voltage electrode and to the nozzle axis, forms one rim of the gap, and the inner wall of sleeve 7 located oppositely around the circumference forms the other boundary of the gap. In the depictions at the top and bottom of FIGS. 7*a* and *b*, flow occurs onto nozzle plate 4 vertically from bottom to top. In both cases, the free electrode end sits downstream at a distance $H_{el}$ in the sleeve before the outlet of the nozzle. High-voltage grid 5 sits at the top physically above nozzle plate 4, i.e. downstream, and at the bottom physically below, i.e. upstream. The concentric potential-line location in the plane of the disk toward the sleeve very quickly approaches concentric circles: more quickly, the more teeth are present around the disk circumference. Field-strength peaks and therefore corona discharges therefore form, with the number of teeth, in the immediate vicinity of the disk.

Distance D between high-voltage grid 5 and the oppositely located end rim of sleeves 7 is dimensioned so that a spark discharge does not occur between any end rim and high-voltage grid 5. The applied high voltage and the geometry of the sleeves and nozzles determine the electrical insulation geometry, which is determined in the operational context from case to case, high-voltage strength being the governing consideration. Distance D from the end face of the sleeve to high-voltage grid 5 is greater than gap width $D_g$ in sleeve 7. The use of the disk sitting concentrically in sleeve 7 makes possible, in electrically simpler fashion, the two designs for high-voltage grid 5 sitting downstream or upstream, since the shortest distance from the material high-voltage potential to the material reference or ground potential is determined by gap width $D_g$. Because the electrical field setting in the gap must necessarily be balanced in terms of the sleeve or nozzle axis, it is useful if the teeth on the disk are distributed uniformly and evenly around the circumference, i.e. if at least two identical teeth project.

FIGS. 8*a-d* depict two design configurations identical to those in FIG. 7. Gas flow 6 is now vertical from top to bottom in both cases, i.e. in the direction of gravity $F_g$. Correspondingly to FIG. 7, the two free electrode ends that are depicted in the form of disk 2 sit downstream from the nozzle plate when high-voltage grid 5 is upstream (top), or downstream (bottom). As in the case of the design having exclusively rod-shaped high-voltage electrodes 1 (FIGS. 1*a*, 3, 5*a* and *b*), for example needle- or pencil-shaped, it is also the case when disks 2 are the free ends of the electrodes that an inclination of $0 \leqq \alpha \leqq 180°$ for installation of the ionizer is possible, and no limitation therefore exists in terms of layout of the flow conduit.

Sleeves 7 that are inserted in nozzle plate 4 have hitherto been depicted as protruding approximately symmetrically, i.e. both downstream and upstream. A substantially plausible electrical argument is to limit the electrical gap fields to the gap geometry, i.e. the electric field proceeding from one high-voltage electrode does not overlap onto a non-associated nozzle. With the plate having no sleeves this was an unavoidable problem that can be kept within limits by technically complex nozzle configuration (edge rounding and nozzle plate thickness), but greatly degrades long-term operation, i.e. does not yield long-term improvement.

FIGS. 10*a-d* depict asymmetrical protrusion of sleeves 7. Experimental findings suggest ranges. With gas flow vertically from top to bottom, the upstream protrusion of the sleeve should be in the range $H_{up}$=1 to 5 $H_{ds}$, $H_{ds}$ being the downstream protrusion. It has been found experimentally that with this flow direction, the protrusions on either side advantageously have a ratio to one another of $H_{up}$=3 $H_d$.

With a gas flow vertically from bottom to top, the experimentally ascertained range changes, and should be from $H_{up}$=0.1 to 1 $H_{ds}$. In this, $H_{up}$=0.1 $H_{ds}$ is the preferred protrusion ratio.

Figure 9A:
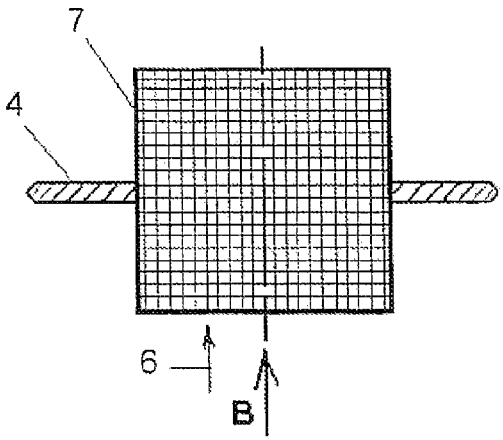
FIGS. 9*a-e* show various sieves on sleeves made of mesh grid, according to an exemplary embodiment of the present invention.
Figure 9E:
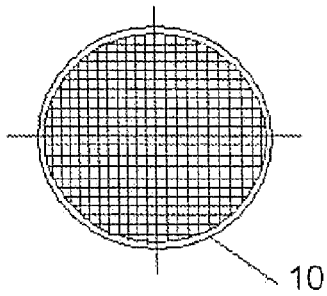
Figure 9C:
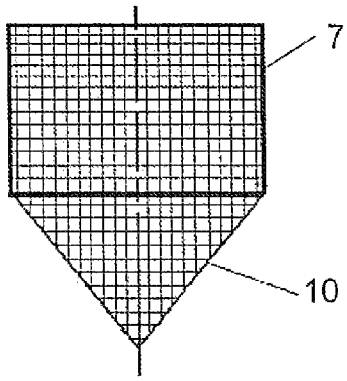
Figure 9D:
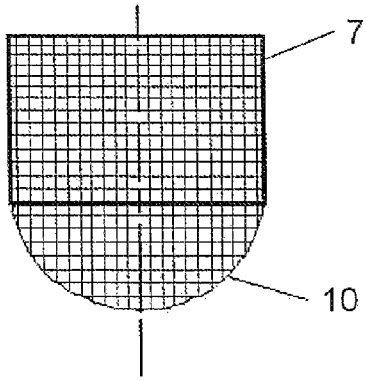
Figure 9B:
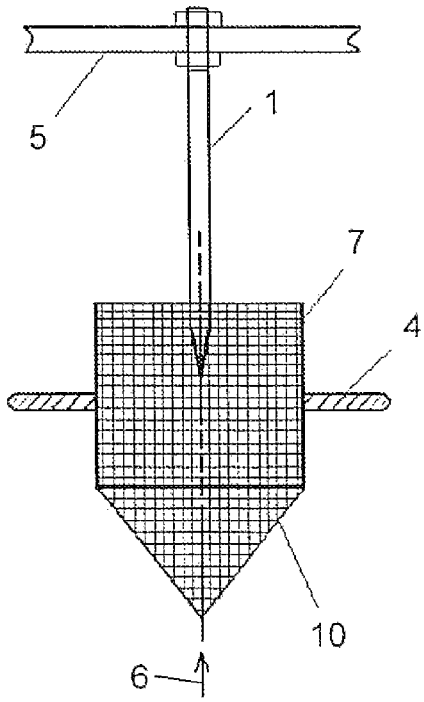
Figure 10A:
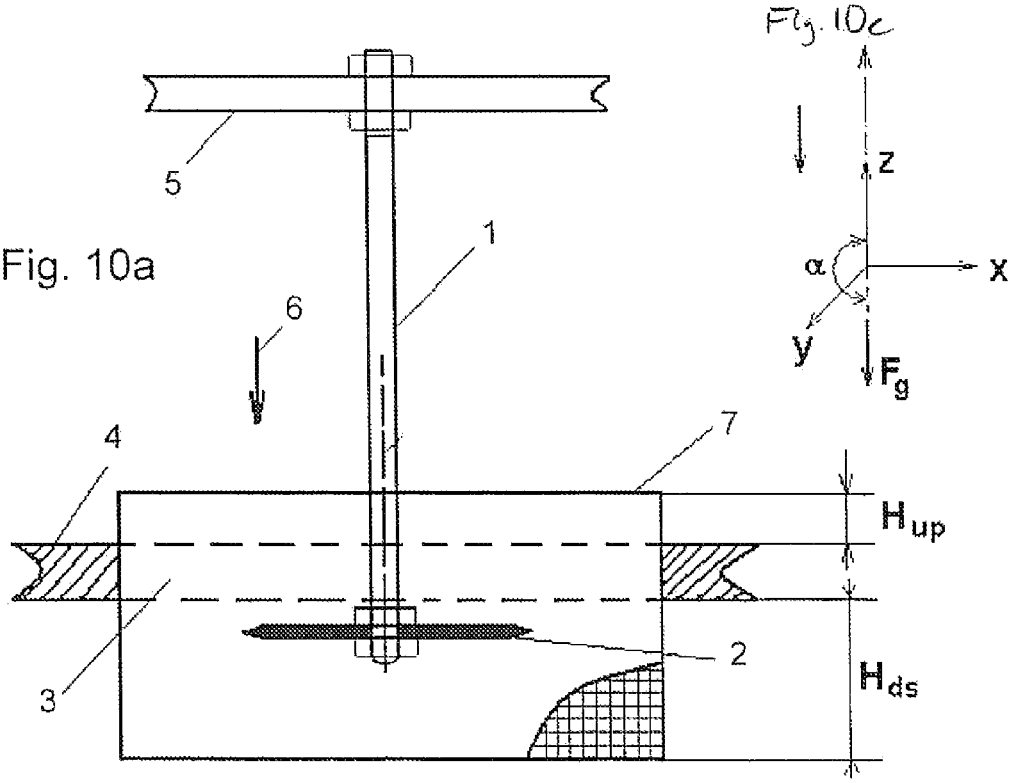
Figure 10B:
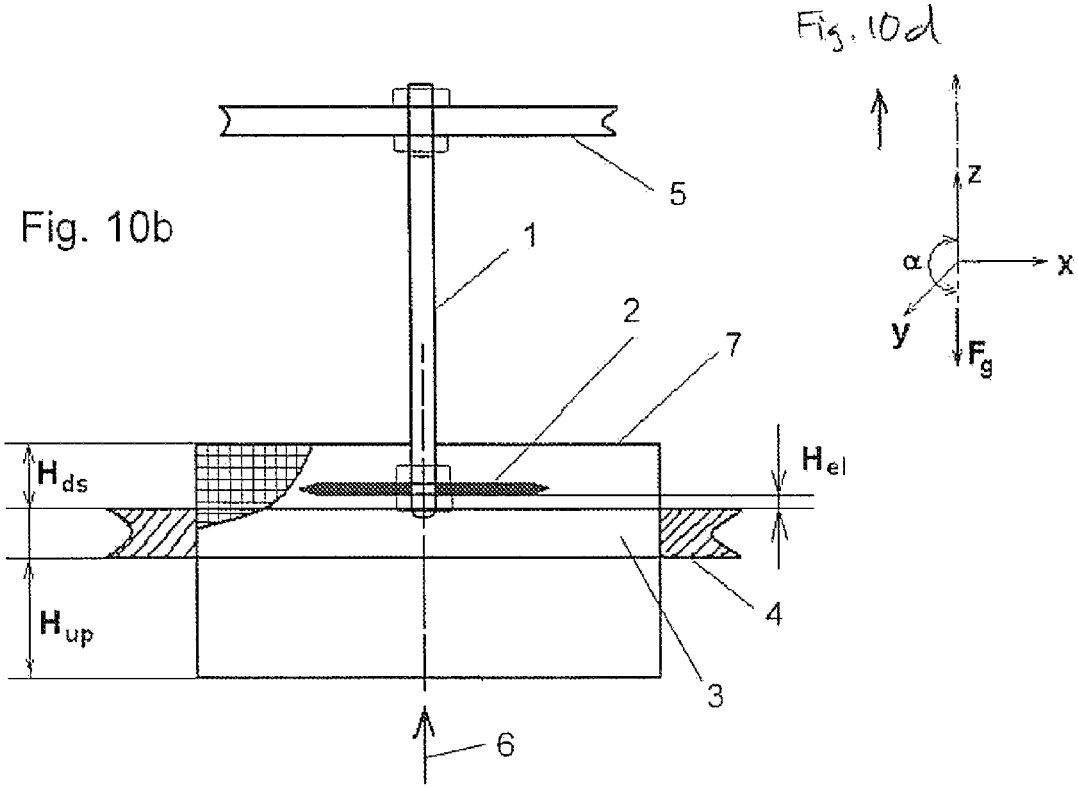

FIGS. 9*a-e* show a simple sleeve geometry, namely cylindrical sleeve 7 made of wire mesh, that has an additional protective device, specifically an additional grid in the form of a sieve 10, to catch larger particles carried along in the gas stream. The sieve covers the flow inlet on sleeve 7 and allows only particles smaller than the mesh size of sieve 10 to pass. This prevents the electrode gap (from the inner sleeve wall to the free end of the high-voltage electrode) in the sleeve space from filling up, clogging, and thereby becoming ineffective. As a result of this sieve feature, however, high-voltage grid 5, with installed high-voltage electrodes 1 each projecting into a sleeve 7, must be installed downstream. FIGS. 9*b-e* show a variety of sieve shapes 10 by way of example: at the top the circular-disk shape, in the middle the conical shape to the left and the semi-spherical shape to the right. In FIG. 9*b*, sieve 10 is once again conical with an indicated high-voltage grid 5 and a bolted-on high-voltage electrode 1 projecting into sleeve 7. Gas stream 6 in FIGS. 9*a* and *b* comes from below. On sieve 10 placed on sleeve 7, particles impacting the sieve mesh are electrically neutralized or shifted to the electrical reference potential of nozzle plate 4.

Nozzle plate 4 fitted with sleeves makes it possible, with simple means, to limit the critical electric field to the gap in the sleeve interior, and at the same time to utilize the electric wind that drives some of the particles electrically accelerated in the gap through the permeable wall of the sleeve; they are then ultimately easily precipitated without being deposited on the ionizer in a manner that influences the field.

LIST OF REFERENCE CHARACTERS

1 High-voltage electrode
2 Disk
3 Nozzle
4 Nozzle plate
5 High-voltage grid
6 Gas flow
7 Sleeve
8 Recess
9 Annular disk
10 Sieve

The invention claimed is:

1. An electrostatic ionization system in a precipitation device for purifying a gas stream passing through it, comprising:

an electrically conductive plate connected to an electrical reference potential, the plate disposed across an open cross section of a flow conduit of the precipitation device and including a plurality of nozzles configured for passage of the gas stream;

a sleeve positive-fittingly disposed on each nozzle coaxial with an axis of the nozzle, the sleeve protruding on both sides of the plate and being an electrical reference potential of the plate;

an electrically insulated high-voltage grid disposed downstream or upstream of the plate across the open cross section of the conduit, the high-voltage grid being connected to a high-voltage potential via a passthrough in a wall of the conduit;

a plurality of rod-shaped high-voltage electrodes each having an end connected to the high-voltage grid and an exposed free end arranged identically centrally in a corresponding one of the nozzles, the electrodes each forming a circumferential gap and arranged at the electrical potential of the high-voltage grid, wherein the free end of each of the electrodes is exposed downstream after the corresponding nozzle, wherein a wall of each sleeve is permeable to the gas stream and includes at least one of a grid, a perforated sheet and individual rods equidistantly spaced from each other and having free ends terminating in a holding ring.

2. The electrostatic ionization recited in claim 1, wherein the free ends of the electrodes have at least one of a rod shape and a taper such that a cross section of the exposed free end becomes smaller.

3. The electrostatic ionization system recited in claim 1, wherein the free end of each of the electrodes include a centrally arranged disk that includes at least two identical extensions evenly distributed around an outer circumference of the respective electrode and extending in a radial direction from a longitudinal axis of the electrode.

4. The electrostatic ionization system as recited in claim 3, wherein the disk includes an end face and the electrode is disposed according to:

$$0 \leqq H_{el} \leqq 0.5 D_g$$

where $H_{el}$ is the distance between the end face and an outlet of the nozzle and $D_g$ is a smallest distance from the free end of the electrode to an inner wall of the sleeve.

5. The electrostatic ionization system according to claim 4, wherein the free end of each of the electrodes has a shape such that a circumscribing enveloping curve thereof has a shape similar to a shape of an open cross section of the nozzle, the enveloping curve being a constant distance $D_g$ from a rim of the corresponding nozzle, the distance between a surface of the corresponding sleeve and a surface of the nozzle defined by a height H in a range $0.5\ D_g \leqq H \leqq 3\ D_g$.

6. The electrostatic ionization system according to claim 5, wherein each of the sleeves includes a constriction around its circumference configured to snap into the corresponding nozzle such that the sleeve is stationary.

7. The electrostatic ionization system according to claim 5, wherein each of the sleeves includes a circumferential annular disk arranged to positively fit in a recess concentric with the corresponding nozzle and in the nozzle plate.

8. The electrostatic ionization system according to claim 7, wherein the free end of each of the electrodes has a rod shape, the respective free end and the high-voltage grid being positioned downstream from the nozzle plate.

9. The electrostatic ionization system according to claim 7, wherein the free end of each of the electrodes includes a disk and is positioned downstream from the nozzle plate.

10. The electrostatic ionization system according to claim 9, wherein each of the sleeves includes an end face that tapers such that a cross section of the end face has a constant shape and becomes larger in the direction of a flow of the gas stream.

11. The electrostatic ionization system according to claim 10, wherein a lower end surface of each of the sleeves is disposed coaxially with the axis of the corresponding nozzle.

12. The electrostatic ionization system according to claim 10, wherein a local elongation of a sleeve wall of each of the sleeves thereof tapers toward the nozzle axis.

13. The electrostatic ionization system according to claim 1, wherein each of the sleeves has at least one of a round cylindrical shape and a columnar shape having a polygonal section, each of the sleeves having a permeable sleeve wall and each of the sleeves includes a sieve disposed at a flow inlet thereof, the sieve having a mesh size at least equal to a passthrough width of the respective permeable sleeve wall, the sieve during operation having the electrical potential of the nozzle plate.

14. The electrostatic ionization system according to claim 2, wherein each of the sleeves has at least one of a round cylindrical shape and a columnar shape having a polygonal section, each of the sleeves having a permeable sleeve wall and each of the sleeves includes a sieve disposed at a flow inlet thereof, the sieve having a mesh size at least equal to a passthrough width of the respective permeable sleeve wall, the sieve during operation having the electrical potential of the nozzle plate.

15. The electrostatic ionization system according to claim 3, wherein each of the sleeves has at least one of a round cylindrical shape and a columnar shape having a polygonal section, each of the sleeves having a permeable sleeve wall and each of the sleeves includes a sieve disposed at a flow inlet thereof, the sieve having a mesh size at least equal to a passthrough width of the respective permeable sleeve wall, the sieve during operation having the electrical potential of the nozzle plate.

* * * * *